US008143787B2

(12) United States Patent
Kikuchi et al.

(10) Patent No.: US 8,143,787 B2
(45) Date of Patent: Mar. 27, 2012

(54) XENON LAMP

(75) Inventors: Yasuro Kikuchi, Himeji (JP); Kyosuke Fujina, Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 239 days.

(21) Appl. No.: 12/472,046

(22) Filed: May 26, 2009

(65) Prior Publication Data

US 2009/0295289 A1 Dec. 3, 2009

(30) Foreign Application Priority Data

May 27, 2008 (JP) ..... 2008-138126

(51) Int. Cl.
*H01J 17/30* (2006.01)

(52) U.S. Cl. ..... 313/601; 313/607; 313/631

(58) Field of Classification Search ..... 313/483–493, 313/623, 627–643, 567, 111–117, 25–27, 313/317, 318.01–318.09, 601–603
See application file for complete search history.

(56) References Cited

U.S. PATENT DOCUMENTS

| | | | | |
|---|---|---|---|---|
| 4,673,843 | A * | 6/1987 | Okanuma | 313/570 |
| 5,608,227 | A | 3/1997 | Dierks et al. | |
| 5,861,715 | A * | 1/1999 | Igarashi et al. | 313/635 |
| 5,932,969 | A * | 8/1999 | Ikeuchi et al. | 313/623 |
| 6,914,383 | B2 * | 7/2005 | Yamashita et al. | 313/594 |
| 2004/0119412 | A1 * | 6/2004 | Katou et al. | 313/607 |

FOREIGN PATENT DOCUMENTS

| | | | |
|---|---|---|---|
| JP | 11-96970 | A | 4/1999 |
| JP | 2004-134104 | A | 4/2004 |
| JP | 2005-566692 | A | 3/2005 |

* cited by examiner

*Primary Examiner* — Nimeshkumar Patel
*Assistant Examiner* — Donald Raleigh
(74) *Attorney, Agent, or Firm* — Roberts Mlotkowski Safran & Cole, P.C.; David S. Safran

(57) ABSTRACT

A xenon lamp having a lamp tube made of silica glass containing titanium oxide and having a discharge chamber with a light emitting part containing xenon and in which a cathode and an anode are arranged in opposition to each other, the cathode and anode being mounted on an end of a respective lead rod, the lamp tube also having side tube parts extending from each of opposite sides of the light emitting part, each lead rod being sealed by a gradient binding part which is arranged in a respective side tube part, and the side tube parts having a narrowed shrink part in a region facing the light emitting part, wherein a conductive film is provided on an outer surface area of the shrink part and an adjoining area of an outer surface of the light emitting part at the cathode side of the lamp tube; and wherein the conductive film is electrically connected to the cathode.

4 Claims, 4 Drawing Sheets

XENON LAMP

BACKGROUND OF THE INVENTION

1. Field of Invention

This invention relates to a xenon lamp used as the light source in projectors using, for example, the Digital Light Processing (DLP®) technology.

2. Description of Related Art

In recent years, use of the digital projector, which enlarges and projects an image on a screen by optically illuminating picture elements, such as DMD (Digital Micro-mirror Device) and liquid crystal devices, using a light source with large output, has been increasing rapidly. High-intensity xenon lamps are used as the light source in such cases, and it is further required to increase the output to reduce the size.

FIG. 1 is a schematic cross sectional view showing a xenon lamp 1 as is disclosed, for example, in Japanese Patent Publication Number 2004-134104. The xenon lamp 1 is composed of: a discharge chamber 10, which is made of silica glass and provided with the light emitting part 2 and side tube parts 3*a*, 3*b*; a cathode 4 and an anode 5, which are arranged facing each other inside the light emitting part 2. The cathode 4 and the anode 5 are supported by a respective lead rod 6, which is made of tungsten. Moreover, a tubular supporting body 7, which is made of cylindrical silica glass, has through holes extending in an axial direction and is disposed and fixed within the side tube parts 3*a*, 3*b*. The lead rod 6 is sealed by a gradient binding part 8 in the side tube parts 3*a*, 3*b* extending through the tubular supporting body 7. The lead rods 6 project and extend outward from the outer end portion of the discharge chamber 10, and serve as the external leads by which electric power is supplied to each of the cathode 4 and the anode 5.

The intensity of the xenon lamp 1 is increased, to be specific, by adjusting the clearance between the cathode 4 and the anode 5 and the amount of the gas filling. For example, when the clearance between the cathode 4 and the anode 5 is shorter than that in a conventional xenon lamp and the amount of the gas filling is increased so that similar electrical properties as those of a conventional xenon lamp may be acquired, the electric input per unit arc length may increase and the outputted optical energy may become larger.

Since the light outputted from the xenon lamp 1 comprises not only the visible light range but the range from the ultraviolet region to the infrared region, if optical energy becomes larger, the output of ultraviolet light may also become larger.

The ultraviolet light of a wavelength of 200 nm or shorter among the light outputted from the xenon lamp 1 not only causes critical defects, such as the distortion of the discharge chamber 10, which is made of silica glass, but also generates ozone by reacting with the air existing around the xenon lamp. When ozone is generated, various damages may happen to optical instruments, such as a decrease in reflectance ratio of the collector mirror or the reflecting mirror and the transmittance of the filter; as a result, the illuminance in the irradiated area is reduced.

It is known that the ultraviolet light of a wavelength of 200 nm or less can be shielded by doping titanium oxide (commonly known as titania) on the discharge chamber 10, which constructs the xenon lamp, or creating a titanium oxide layer on the surface of the discharge chamber 10. By including titanium oxide in the discharge chamber 10, the ultraviolet light can be shielded and the generation of ozone can be prevented. The doping technique of titanium oxide is disclosed, for example, in Japanese Patent Publication Number H8-96751 (U.S. Pat. No. 5,608,227A), and the coating technique of titanium oxide is disclosed, for example, in Japanese Patent Publication Number H11-96970.

However, if the xenon lamp using silica glass and titanium oxide is turned on for a long time, white crystals are deposited on the surface of the glass that is exposed to the emission space of the discharge chamber. In the crystallized area, cracks have occurred on the surface of the emission space of the discharge chamber, and the titanium oxide layer, which shields the ultraviolet light, is destroyed. Therefore, the ultraviolet light generated in the emission space enters the cracks, critical defects, which cause the distortion of the silica glass that forms the discharge chamber, may happen, and this causes the burst of the discharge chamber.

SUMMARY OF THE INVENTION

This invention is made to solve the above mentioned problems and to prevent crystal deposition on the surface which is exposed to the emission space of the discharge chamber, in xenon lamps using silica glass and in which the discharge chamber contains titanium oxide, and to provide a xenon lamp which does not causes bursting of the discharge chamber.

In accordance with a preferred embodiment of the invention, the xenon lamp is characterized by the fact that the connecting part between the side tube part in the cathode side and the light emitting part is a shrink part; a conductive film is formed on the outer surface of the shrink part and the part of the outer surface of the light emitting part following the shrink part; and the conductive film is electrically connected to the cathode; wherein the xenon lamp comprises silica glass containing titanium oxide. The lamp is provided with a discharge chamber, which has the above mentioned light emitting part and the above mentioned side tube parts that extend from opposite sides of the light emitting part; the cathode and the anode are arranged inside the above mentioned light emitting part in a way that they are facing each other; the lead rod, which is equipped with the above mentioned cathode or the above mentioned anode on one of the ends, is sealed by a gradient binding part prepared inside the above mentioned side tube part; and xenon is enclosed within the above mentioned discharge chamber.

Another aspect of the invention is that a preferred embodiment of the invention has a remnant portion of an exhaust pipe formed in the area between the above mentioned light emitting part and the side tube part at the cathode side and a trigger wire, which is electrically connected to the anode, is disposed from the above mentioned remnant portion of the exhaust pipe to the outer surface at the anode side.

A further feature of the invention is that a preferred embodiment has caps attached to both ends of the discharge chamber; one of the caps and the cathode being electrically connected; the equipotential wire derived from one of the caps is connected with the conductive film.

According to the xenon lamp of the invention, crystallization on the surface exposed to the emission space of the discharge chamber can be prevented by forming the conductive film on the outer surface of the shrink part of the connecting part between the light emitting part and the side tube part at the cathode side and a part of the outer surface of the light emitting part continuing to the shrink part; and by electrically connecting the conductive film to the cathode to make the electrical potential of the conductive film the same as that of the cathode.

According to the invention, the trigger wire can be prevented from moving toward the cathode since the remnant portion of the exhaust pipe protrudes and the trigger wire, which is electrically connected to the anode, is held by the remnant portion toward the anode side to keep the trigger wire from touching the conductive film, which has the same potential as the cathode; therefore, the effect of assisting the starting performance by the trigger wire will not be impaired.

According to the invention, by contacting the equipotential wire derived from the cap, which is electrically connected to the cathode, is in contact with the conductive film, the electrical potential of the conductive film formed on the outer surface of the discharge chamber can easily be made the same as that of the cathode.

DETAILED DESCRIPTION OF THE INVENTION

Figure 1:
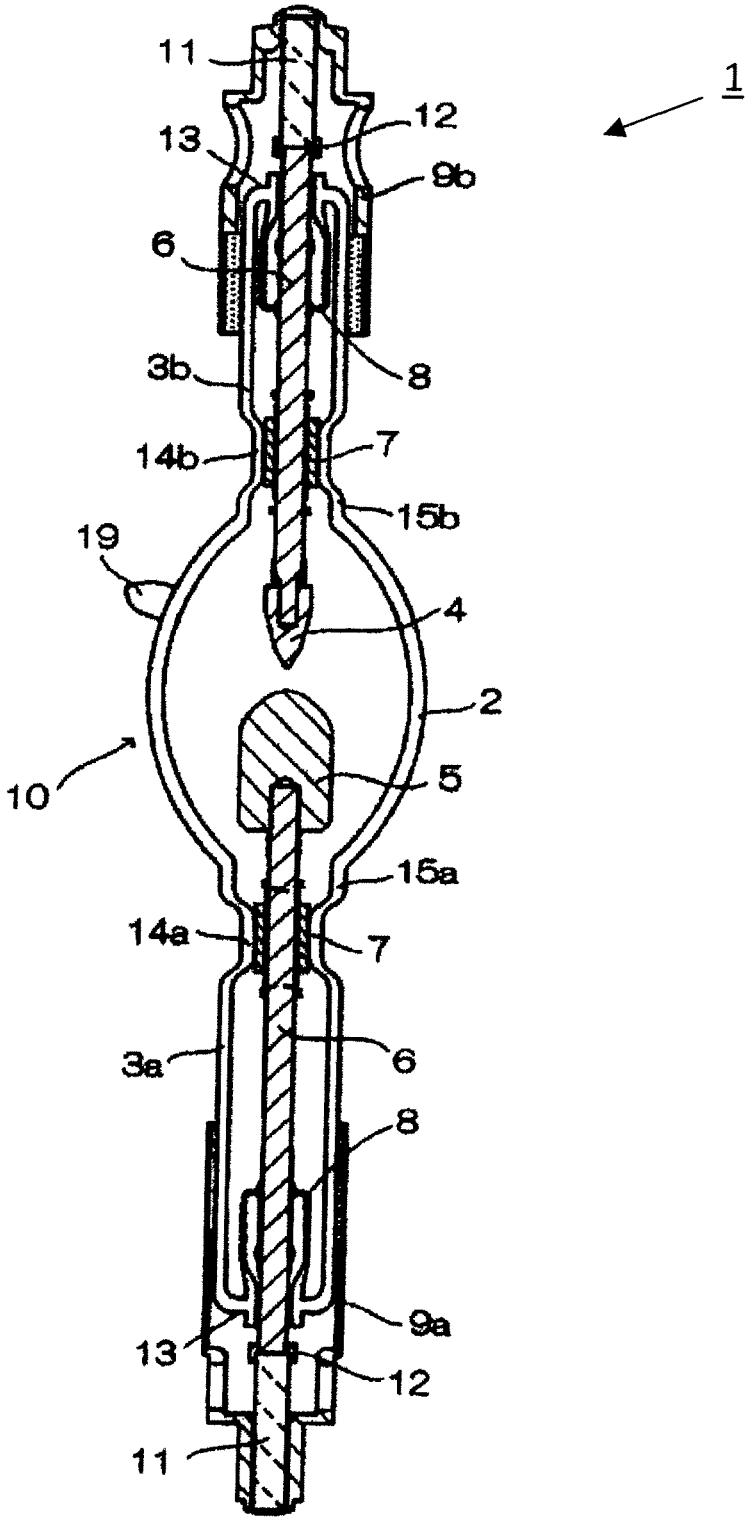
Fig. 1 (Prior Art)
FIG. 1 is a cross-sectional view showing the structure of a known xenon lamp.

FIG. 1 shows the structure of a known xenon lamp 1 described above which has a light emitting part 2; a discharge chamber 10 with side tube parts 3*a*, 3*b*, extending from each of opposite sides of the light emitting part 2; and a cathode 4 and an anode 5, which are arranged in opposition to each other in the light emitting part 2. The discharge chamber 10 is made of silica glass containing titanium oxide that is configured to shield the ultraviolet light of a wavelength of 200 nm or less. Xenon (Xe) is contained as a discharge gas in the discharge chamber 10, which is composed of a light emitting part 2, which has an almost spherical shape, and cylindrical side tube parts 3*a*, 3*b*, which extend from both opposite sides of the light emitting part 2.

Brass caps 9*a*, 9*b*, which are cylinders with a closed bottom, are placed on both ends of the discharge chamber or, more specifically, the side tube parts 3*a*, 3*b*. The caps 9*a*, 9*b* are mounted on the end of the body of the hollow cylinder in a way that they will cover the end parts of the discharge chamber 10. The caps 9*a*, 9*b* are fixed by an adhesive agent provided between the caps and the discharge chamber 10. A conductive wire 11, which is made with twined copper wires, extends into the center of the inner parts of the caps 9*a*, 9*b*, and is electrically connected to the lead rod 6 by the brazing 12.

A respective lead rod 6 extends from each end of the discharge chamber 10 and is configured as a, so called, rod seal, where the lead rod is supported by a gradient binding part 8 and a support tube body 7, which is placed inside the side tube parts 3*a*, 3*b*. At the end of the side tube parts 3*a*, 3*b* is placed a toric end wall part 13; and the cylindrical gradient binding part 8 is connected at the inner peripheral end part of the end wall part 13. The gradient binding part 8 is formed of graded binding glass (also known as intermediate glass), which has a coefficient of thermal expansion between, for example, that of silica glass which composes the discharge chamber 10 and that of tungsten which composes the lead rod 6. The lead rod 6 is sealed by attaching the end part of the gradient binding part 8, which is on the light emitting part 2 side, to the outer peripheral of the lead rod 6, wherein the gradient binding part is placed in a way that it extends along the lead rod 6 toward the light emitting part 2.

Shrink parts 14*a*, 14*b*, whose diameters are reduced toward the central axis, are placed in the connecting part of the side tube parts 3*a*, 3*b* of the light emitting part 2. The shrink parts 14*a*, 14*b* are the connecting parts of the side tube parts 3*a*, 3*b* and the light emitting part 2, and straight tube parts 15*a*, 15*b* are formed between the shrink parts 14*a*, 14*b*, respectively and the discharge chamber 10.

The cylindrical support tube bodies 7 are placed inside the shrink parts 14*a*, 14*b*, and a metal foil is wrapped around the outer surface of the cylindrical bodies. The shrink parts 14*a*, 14*b* are made by heating and contracting them to a smaller diameter so that they are touching the support tube bodies 7 to prevent the support tube bodies 7 from moving around and to fix them in place. Also, the lead rods 6, whose outer surfaces are wrapped with metal foil, are inserted into through holes in the middle of the supporting bodies 7 and support the electrodes 4, 5, which are connected to the tip of the lead rods 6.

Thus, the electrodes 4, 5, which are formed at the tips of the lead rods 6, are supported by the side tube parts 3*a*, 3*b*, and are placed to face each other inside the light emitting part 2. In addition, the cathode 4 and the anode 5 are electrically connected to the caps 9*a*, 9*b* through the lead rods 6.

Examples of the dimensions of the xenon lamp 1 are as follows: the outer diameter of the most expanded part of the light emitting part 2 is in a range from 40 mm to 80 mm, for example, 60 mm; the inner surface area of the approximately spherical shaped light emitting part 2 is in a range from 4800 to 20400 $mm^2$, for example, 10700 $mm^2$; the clearance between the anode 5 and the cathode 4 is in a range from 3 to 8 mm, for example, 4.5 mm; the input power, when the light is on, is in a range of 3000 to 7000 W, for example, 4200 W; and the bulb wall load of the light emitting part, when the light is on, is from 0.3 to 0.5 $W/mm^2$, for example, 0.38 $W/mm^2$.

Then, lighting experiments were performed on three lamps with different specifications in order to find the conditions where crystallization occurs on the surface, which is exposed to the emission space in the discharge chamber.

The specifications of these three lamps are as follows:

Lamp 1 Xenon Lamp

Discharge chamber: silica glass containing titanium oxide; total length of 300 mm; outer diameter of the most expanded part of the light emitting part is 60 mm; and the total length of the light emitting part is 80 mm.

Sealing structure: rod seal

Gas filling: xenon (Xe) 2 MPa (static pressure)

Clearance between anode and cathode: 4.5 mm

Input power: 4 kW

Lamp 2 Xenon Lamp

Xenon lamp made in the same way as the specification of the lamp 1, except the material of the discharge chamber is silica glass which does not contain titanium oxide.

Lamp 3 Mercury Lamp

Discharge chamber: silica glass containing titanium oxide; total length of 300 mm; outer diameter of the most expanded part of the light emitting part is 80 mm; total length of the light emitting part is 90 mm.

Sealing structure: foil seal

Gas filling: xenon (Xe) 0.2 MPa (static pressure) mercury 30 $mg/cm^3$

Clearance between anode and cathode: 5.0 mm

Input power: 4 kW

Figure 2:
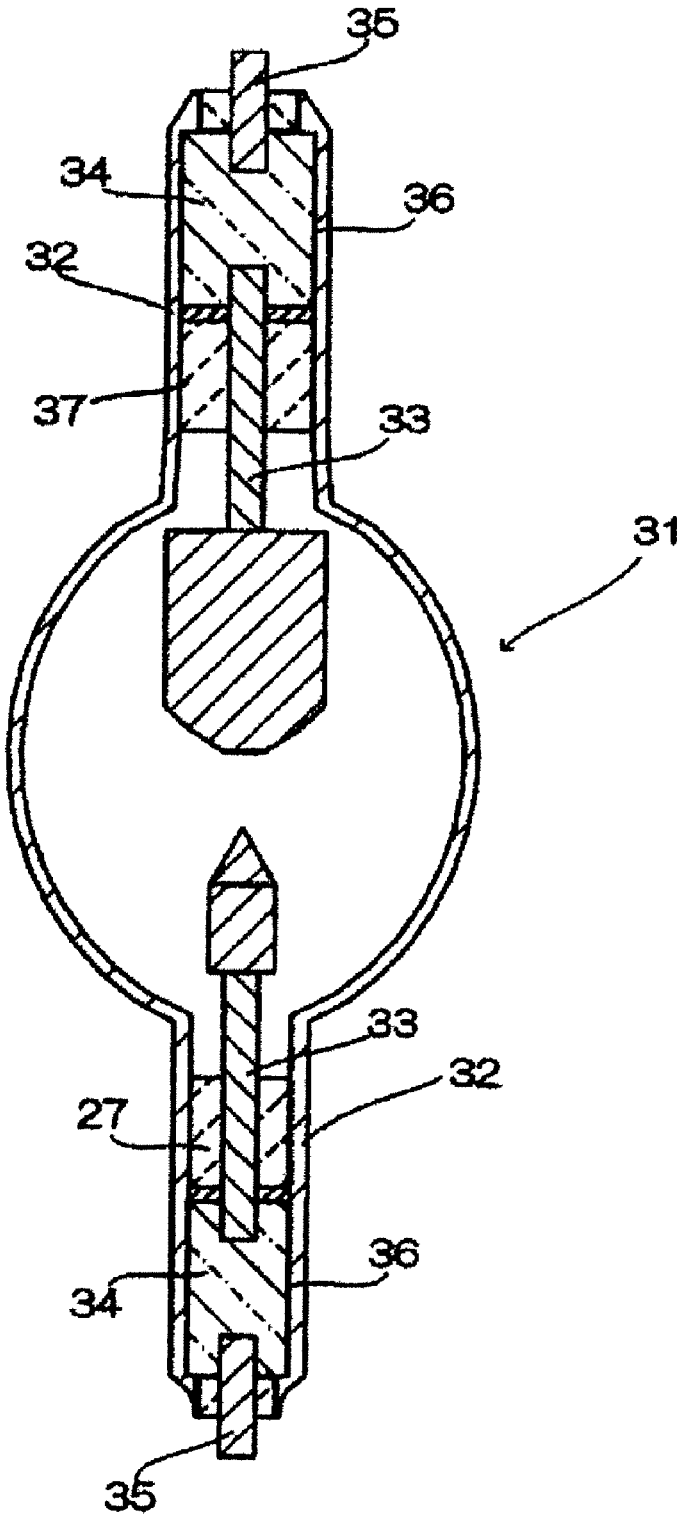
Fig. 2 (Prior Art)
FIG. 2 is a cross-sectional view showing the structure of a mercury lamp having a foil seal structure.

The foil seal used in the mercury lamp sealing structure of the lamp 3 has the structure shown in FIG. 2.

In the sealing structure using the foil seal, one end of the internal lead 33 is provided with the electrode and the other end is supported by an approximately cylindrical glass member 34, which is made with silica glass and is disposed in the sealing part 32. In addition, one end of an external lead 35, which is placed to extend out from the discharge chamber 31, in other words, to extend outward from the outer end of the sealing part 32, is also supported by the glass member 34.

Five strips of metal foil 36 are separated from each other in the direction of the circumference and disposed in parallel on the outer peripheral surface of the glass member 34 along the direction of the tube axis of the mercury lamp. One end of each metal foil 36 is electrically connected to the internal lead 33 and the other end is electrically connected to the external lead 35. The sealing part 32 and the glass member 34 in the discharge chamber 31 are welded via the metal foil 36 to form an airtight seal structure. The internal lead 33 is inserted to a support tube body 37; in this way, the support tube body 37 is supporting the internal lead 33 and is welded to the sealing part 32.

Thus, with the foil seal, an airtight seal structure is formed with the glass member 34; therefore, the gas filling is not filled to the end of the sealing part 32, where the temperature is kept low also in the time of lighting. In order to prevent mercury from being unevaporated by the gas filling cooling down, it is necessary to use a sealing structure such as a foil seal in a mercury lamp.

On the other hand, the sealing structure of the xenon lamp is required to have high resistance to pressure, since the pressure of the gas filling is high. When the foil seal is adopted, it can easily crack from the spaces between the strips of the metal foil 36. Crack formation will be even more easy with increased number of the spaces between the strips of the metal foil 36; accordingly, the foil seal is not suitable for the light source of digital projectors, for which high intensity is particularly required. Therefore, it is necessary to use a rod seal in the sealing structure of a xenon lamp. Cracks will not easily occur with the rod seal, since the sealing is made by the gradient binding part 8.

It was observed whether crystallization will occur on the surface which is exposed to the emission space of the discharge chamber by turning on the lamps 1 to 3.

The lamps were lit for two hours and then turned off for 30 minutes; and this was repeated again. In other words, the lamps were lit for two hours at a time with a thirty-minute interval. Observations of the existence of crystallization were visually performed at the time of turning the lights off, whenever the lighting time passed 50 hours. This was repeated until crystallization occurred.

Crystallization is different from milky opacification inside the discharge chamber, and is accompanied by a minute cracking of the discharge chamber. When crystallization occurs, silica glass, which composes the discharge chamber, will peel off on the surface, which is exposed to the emission space, and minute whitish glass fragments will be generated. Since a similar phenomenon as the phenomenon, which happens when cracks occur in the discharge chamber, will arise, this can be visually confirmed by those skilled in the art. The time when such phenomenon occurred was considered as the time that crystallization occurred, and the integrated lighting time was recorded.

Crystallization occurred after 100 hours of lighting in the lamp 1.

Crystallization did not occur even after 500 hours of lighting in the lamp 2. Herein, 500 hours is the average life of the xenon lamp.

Crystallization did not occur even after 1000 hours of lighting in the lamp 3.

The experiment results of the lamp 1 and the lamp 2 showed that crystallization occurred only when silica glass, which contains titanium oxide, was used for the discharge chamber. It turned out that titanium oxide, which is included in the discharge chamber, plays certain roles in crystallization.

Moreover, the experimental results of the lamp 1 and the lamp 3 showed that crystallization did not occur in the mercury lamp, which contains mercury. This is considered to be because the intensity of xenon excimer radiation with a main wavelength of 172 nm of the xenon lamp is stronger than that of the mercury lamp. This is because the xenon lamp contains more volume of the xenon gas in it. It is also clear from the fact that the xenon filling pressure of the xenon lamp is higher than that of the mercury lamp.

Figure 3:
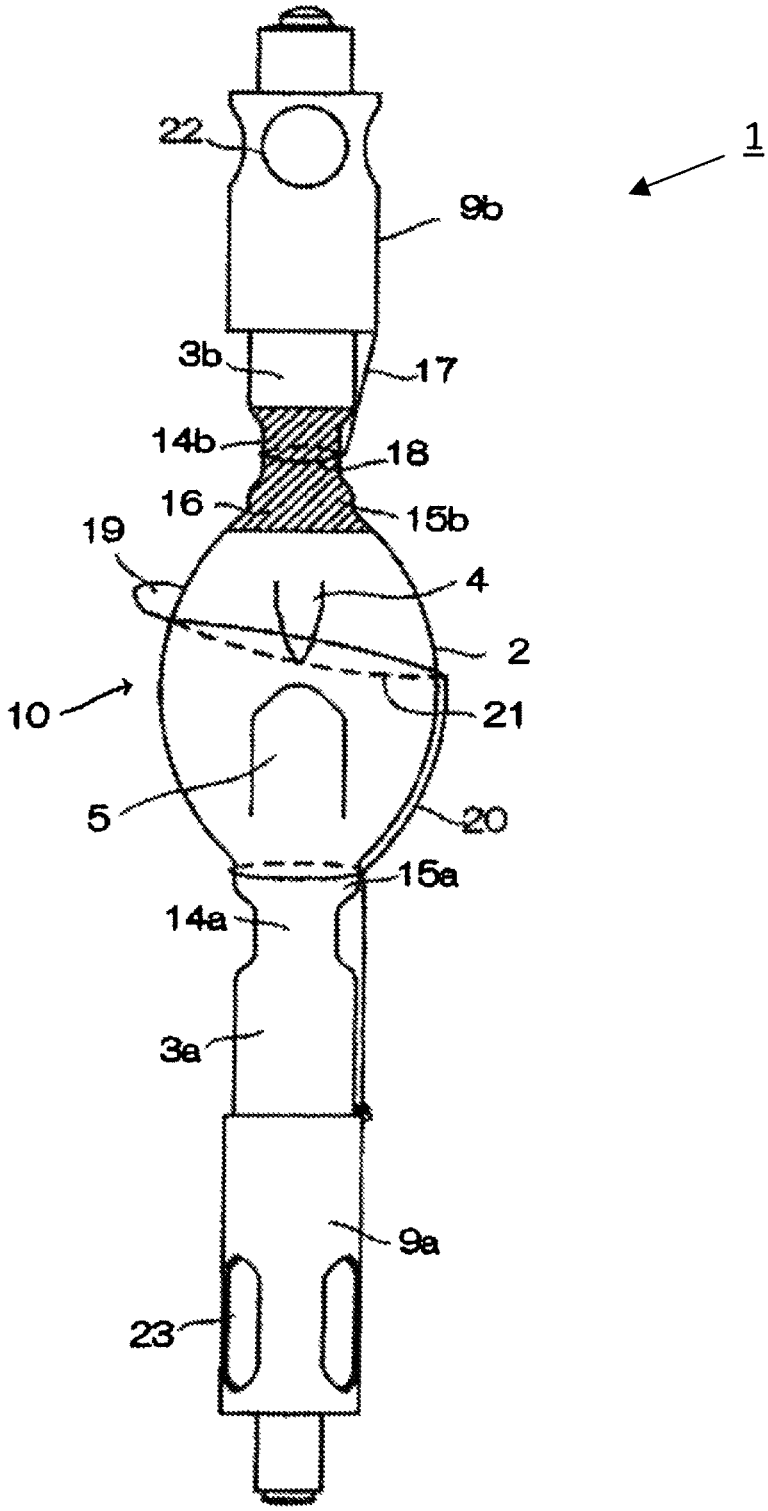
FIG. 3 is an explanatory diagram showing an external view of a xenon lamp in accordance with the invention, and FIGS. 4(*a*)-(*c*) are explanatory views of the part of the xenon lamp showing the area where a conductive film is formed.

The inventors of this invention made the best effort to create a composition to prevent crystals to deposit on the surface exposed to the emission space in the xenon lamp, which uses silica glass containing titanium oxide for the discharge chamber in order to control the generation of ozone, and came up with an idea to adopt the xenon lamp shown in FIG. 3.

FIG. 3 is an explanatory diagram showing an external view of a xenon lamp of this invention.

A conductive film 16, which is made, for example, of gold or platinum, is formed on the outer surface of the connecting part between the side tube part and the light emitting part at the cathode side. The conductive film 16 may be formed on the outer surface of the shrink part 14*b* and the straight tube part 15*b*, as well as on the outer surface of the part of the side tube part 3*b*, which connects to the shrink part 14*b*, and a part of the light emitting part 2, which connects to the straight tube part 15*b*.

Furthermore, an equipotential wire 17, which extends along the side tube part 3*b* at the cathode side, is disposed from the cap 9*b* in the cathode side; wherein the side tube part 3*b* comprises a linear member of a diameter of 0.5 mm which is made of nickel-chromium alloy. One end of the equipotential wire 17 is electrically connected to the cap 9*b* at the cathode side, for example, by passing through a small hole on the cap 9*b* and twisted to be fixed. The equipotential wire 17 extends the from cap 9*b* at the cathode side and extends on the outer surface of the side tube part 3*b* along the direction of the tube axis, and an annular transmitting part 18, which goes around the shrink part 14*b* once, is formed around the shrink part 14*b* at the cathode side. Since the conductive film 16 is formed on the outer surface of the shrink part 14*b* at the cathode side, it is possible to make the electrical potential the same as that of the cathode by contacting the transmitting part 18 with the conductive film 16, which causes the conductive film 16 to be electrically connected to the cathode 4.

Furthermore, in the light emitting part 2, a remnant portion 19 of an exhaust pipe is formed in an area from the connecting part with the side tube part 3*b* at the cathode side of the discharge chamber part. In the manufacturing process of the xenon lamp, after the discharge chamber 10, which comprises the light emitting part 2, to which the exhaust pipe is connected and the side tube parts 3*a*, 3*b*, which support the lead rod 6 provided with the cathode 4 or the anode 5, is formed, the xenon gas is injected through the exhaust pipe. Since the xenon lamp 1 of this invention has the sealing structure shown in FIG. 1, the xenon gas flows into the inside of the side tube parts 3*a*, 3*b* through the space at the support tube body 7 and reaches an area where the lead rod 6 is sealed by the gradient binding part 8. The exhaust pipe is closed and cut off, and the remaining part will become the remnant portion 19 of the exhaust pipe.

In addition, as shown in FIG. 3, a trigger wire 20 is provided, which extends from the side tube part 3*a* at the anode side to the light emitting part 2. One end of the trigger wire 20 is electrically connected to the cap 9*a* at the anode side, extending on the outer surface of the side tube part 3*a* along a direction of the tube axis, and then an annular part 21, which goes around the expanded part of the light emitting part 2 once, is formed. At the outer surface of the light emitting part 2, the annular part 21 is formed between the anode 5 and the cathode 4 or over the cathode 4 relative to the direction of the tube axis of the light emitting part 2, but at the side of the anode 5 relative to the remnant portion 19 of the exhaust pipe. The protrusion of the remnant portion 19 of the exhaust pipe functions to prevent the annular part 21 from moving toward the shrink part 14*b* on the cathode side.

Providing the trigger wire 20 on the outer surface of the light emitting part 2 can lower the breakdown voltage of the xenon lamp 1 when the lighting starts. By lowering the breakdown voltage, the voltage load of the lighting device can be decreased, and problems, such as leaking of the starting voltage applied from the lighting device, enlargement, or the increase of the cost of the lighting device, can be solved.

In addition, since the trigger wire 20 is disposed in a way that it is prevented from moving toward the cathode side by the protrusion of the remnant portion 19 of the exhaust pipe, the trigger wire 20 is prevented from contacting the conductive film 16; therefore, the effects of the trigger wire 20 assisting the starting performance are not spoiled.

Moreover, two or more circular holes 22 are placed on the outer periphery of the side of the cap 9*b* of the cathode side, and two or more ellipsoidal holes 23 are placed on the outer periphery of the side of the cap 9*a* of the anode side. These circular holes 22 and the ellipsoidal holes 23 are placed to cool the side tube parts 3*a*, 3*b* of the xenon lamp 1. The shapes and sizes of the holes 22, 23 may be selected as needed.

Then, for the xenon lamp of the above mentioned embodiment, in order to confirm whether crystallization occurs on the surface, which is exposed to the emission space in the discharge chamber, lighting experiments were performed using measuring objects under two conditions.

Lamp 4 Xenon Lamp

A xenon lamp made in the same way as the specification of the lamp 1, except for a conductive film being formed on the outer surface of the connecting part between the side tube part and the light emitting part in the cathode side.

Lamp 5 Xenon Lamp

A xenon lamp made in the same way as the specification of the lamp 4, except for an equipotential wire being provided, which extends along the side tube part of the cathode.

The lamps 4 and 5 were turned on under the same conditions as those used for the lamps 1 to 3 to observe whether crystallization occurs on the surface, which is exposed to the emission space in the discharge chamber.

Crystallization occurred after 100 hours of lighting in the lamp 4.

Crystallization did not occur even after 500 hours of lighting in the lamp 5.

Based on the experimental results of lamps 4 & 5, it became clear that crystallization on the surface, which is exposed to the emission space of the discharge chamber, can be prevented by not only forming a conductive film on the outer surface of the connecting part between the light emitting part and the side tube part in the cathode side, but also by making the electric potential of the conductive film the same as that of the cathode. It is assumed that alkali-metal ions in the silica glass play some role in the generation of crystallization and move to the inside due to the potential difference of the external and internal surfaces of the glass. In this experiment, it is possible to prevent the outer surface of the bulb from being positively charged by providing the conductive film and making the electrical potential of the conductive film the same as that of the cathode. As a result, the difference between the potential of the inside and outside of the bulb can be reduced; therefore, it is thought that it can prevent the alkali-metal ion from moving to the inner surface of the bulb.

Then, lighting experiments were performed on measuring objects under three different conditions in order to confirm whether crystallization occurs on the surface, which is exposed to the emission space in the discharge chamber when various forming areas of the conductive film are used.

Lamp 6 Xenon Lamp

Figure 4:
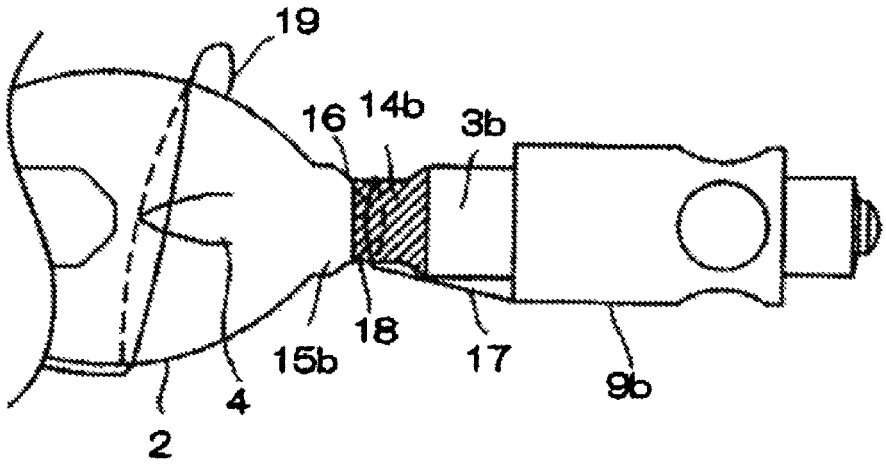
Figure 4:
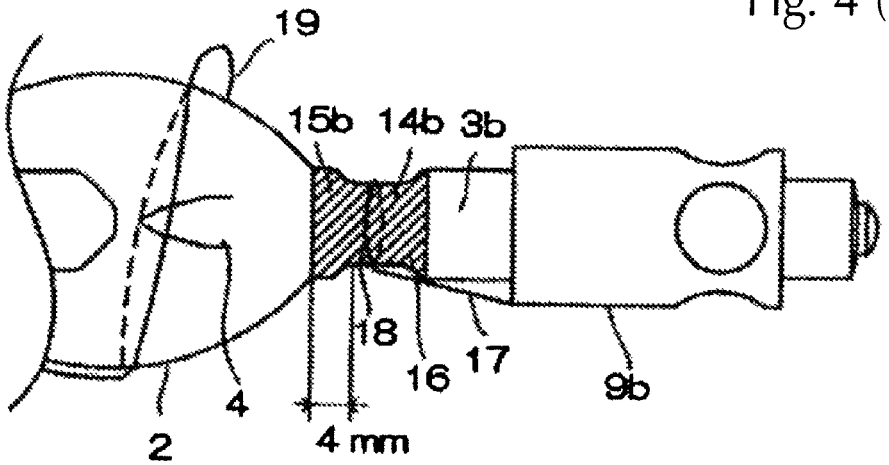
Figure 4:
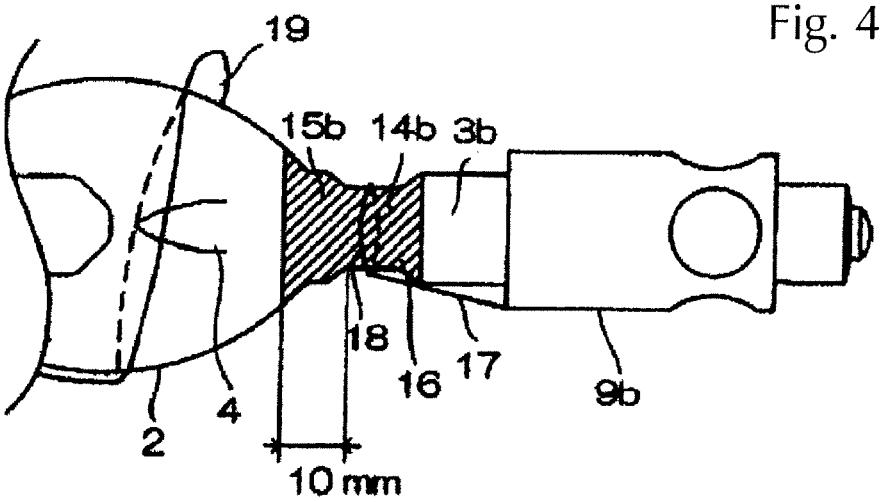

A xenon lamp made in the same way as the specification of the lamp 5, except for the area where the conductive film 16 is provided being moved to the shrink part 14*b* and the outer surface of the part of the side tube part 3*b* connecting to the shrink part 14*b*, as shown in FIG. 4(*a*). In addition, an equipotential wire 17 is provided and the conductive film 16 has the same potential as the cathode.

Lamp 7 Xenon Lamp

A xenon lamp made in the same way as the specification of the lamp 6, except the forming area of the conductive film 16 is expanded not only to the shrink part 14*b* and the outer surface of a part of the side tube part 3*b* connecting to the shrink part 14*b*, but also to the outer side of the straight tube part 15*b*, as shown in FIG. 4(*b*). The forming area of the conductive film 16 is expanded 4 mm to the light emitting part side in the direction of the axis from the end of the conductive film 16 of the lamp 6 in the light emitting part.

Lamp 8 Xenon Lamp

A xenon lamp made in the same way as the specification of the lamp 6, except the forming area of the conductive film 16 is expanded not only to the shrink part 14*b* and the outer surface of the part of the side tube part 3*b* connected to the shrink part 14*b*, but also to the straight tube part 15*b* and the outer surface of the part of the light emitting part 2 connecting to the straight tube part 15*b*, as shown in FIG. 4(*c*). The forming area of the conductive film 16 is expanded 10 mm to the light emitting part side in the direction of the axis from the end of the conductive film 16 of the lamp 6 in the light emitting part.

The lamps 6 to 8 were turned on under the same conditions as those used for the lamps 1 to 3 to observe whether crystallization occurs on the surface, which is exposed to the emission space of the discharge.

Crystallization occurred after 100 hours of lighting in the lamp 6.

Crystallization did not occur even after 500 hours of lighting in the lamp 7.

Crystallization did not occur even after 500 hours of lighting in the lamp 8.

Based on the experimental results of the lamps 6 to 8, there is no effect to control the crystallization when the forming area of the conductive film is only the outer surface of the shrink part. However, it became clear that the crystallization can be controlled when the conductive film is formed on the outer surface of the straight part connecting the shrink part as in the lamp 7, or on the outer surface of the expanded part connecting to the straight tube part as in the lamp 8, in addition to the lamp 7. In other words, it was found that crystallization cannot be controlled when the conductive film is formed only on the shrink part, which is the connecting part between the light emitting part and the side tube part in the cathode side and the electric potential of the conductive film is made as same as that of the cathode; but crystallization is controlled when the conductive film is also formed on the outer surface of the part of the light emitting part connected to the shrink part and the electric potential of the conductive film is made as same as that of the cathode.

In addition, light cannot be emitted from the emission space efficiently when the conductive film is formed in a way that it covers the surface of the outer surface of the light emitting part by expanding the forming area of the conductive film. Therefore, it is necessary to make the forming area of the conductive film not to cover the light distribution angle.

What is claimed is:

1. A xenon lamp, comprising:

a lamp tube made of silica glass containing titanium oxide and having a discharge chamber with a light emitting part containing xenon and in which a cathode and an anode are arranged in opposition to each other, the cathode and anode being mounted on an end of a respective lead rod, the lamp tube also having side tube parts extending from each of opposite sides of the light emitting part, each lead rod being sealed by a gradient binding part which is arranged in a respective side tube part, and the side tube parts having a narrowed shrink part in a region facing the light emitting part, wherein a conductive film is provided on an outer surface area of the shrink part and an adjoining area of an outer surface of the light emitting part at the cathode side of the lamp tube; and wherein the conductive film is electrically connected to the cathode.

2. The xenon lamp described in claim 1, wherein a remnant portion of an exhaust pipe is located on the cathode side of the lamp tube in an area between the most expanded part of the light emission part and the areas on which the conductive film is provided and wherein a trigger wire is electrically connected to the anode and is disposed on the remnant portion of the exhaust pipe at the anode side thereof.

3. The xenon lamp described in claim 2, wherein a cap is attached on an end of each of the side tube parts, the cap on the cathode side being electrically conducting and wherein an equipotential wire extends from said electrically conducting cap into contact with the conductive film.

4. The xenon lamp described in claim 1, wherein a cap is attached on an end of each of the side tube parts, the cap on the cathode side being electrically conducting, and wherein an equipotential wire extends from said electrically conducting cap into contact with the conductive film.

* * * * *